US006231906B1

(12) United States Patent
Alessi

(10) Patent No.: US 6,231,906 B1
(45) **Date of Patent: *May 15, 2001**

(54) PACKAGING SYSTEM FOR TART SHELLS

(75) Inventor: Philip Alessi, Tampa, FL (US)

(73) Assignee: Cake Box Bakeries, Inc., Tampa, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,581

(22) Filed: Nov. 17, 1998

(51) Int. Cl.[7] ..... B65D 81/05

(52) U.S. Cl. ..... 426/119; 426/90; 426/128; 426/106

(58) Field of Search ..... 426/119, 90, 115, 426/128, 106; 206/470, 471, 521.8

(56) References Cited

U.S. PATENT DOCUMENTS

| | | | | |
|---|---|---|---|---|
| 2,793,955 | | 5/1957 | Selmer . | |
| 3,122,441 | * | 2/1964 | Smith | 206/471 |
| 3,131,846 | * | 5/1964 | Whiteford | 206/521.8 |
| 3,234,030 | * | 2/1966 | Knirim | 426/119 |
| 3,356,277 | * | 12/1967 | Hohnjec | 206/521.8 |
| 3,406,856 | * | 10/1968 | Griffith et al. | 426/128 |
| 3,431,836 | | 3/1969 | Murrell . | |
| 3,447,731 | * | 6/1969 | Lehmann | 206/521.8 |
| 3,512,458 | | 5/1970 | Ehe . | |
| 3,637,404 | * | 1/1972 | MacManus | 426/128 |
| 3,643,857 | * | 2/1972 | Noguchi | 206/521.8 |
| 3,676,159 | * | 7/1972 | Fallowfield | 206/471 |
| 3,692,544 | | 9/1972 | Dendrinos . | |
| 3,728,957 | | 4/1973 | Polus . | |
| 3,732,976 | | 5/1973 | Bessett et al. . | |
| 3,799,386 | | 3/1974 | Madalin et al. . | |
| 3,865,953 | * | 2/1975 | Peters | 426/124 |
| 3,874,548 | | 4/1975 | Buff, Jr. . | |
| 4,057,188 | * | 11/1977 | Steinhardt | 206/521.8 |
| 4,381,837 | * | 5/1983 | Cortopassi | 426/128 |
| 4,398,633 | * | 8/1983 | Weinstein | 426/128 |
| 4,399,157 | * | 8/1983 | Caporaso | 426/128 |
| 4,426,002 | | 1/1984 | Rez . | |
| 4,435,434 | * | 3/1984 | Caporaso | 426/128 |
| 4,472,440 | * | 9/1984 | Bank | 426/128 |
| 4,499,353 | * | 2/1985 | Shields | 206/470 |
| 4,842,143 | * | 6/1989 | McKee et al. | 426/119 |
| 4,874,083 | | 10/1989 | Antoni et al. . | |
| 4,896,774 | | 1/1990 | Hammett et al. . | |
| 5,082,677 | * | 1/1992 | Bear | 426/128 |
| 5,695,062 | * | 12/1997 | Lemaire | 206/521.8 |
| 5,858,428 | * | 1/1999 | Truscello et al. | 426/90 |

* cited by examiner

*Primary Examiner*—Steven Weinstein
(74) *Attorney, Agent, or Firm*—Larson & Larson, P.A.; James E. Larson

(57) ABSTRACT

A packaging system for tart shells includes transparent plastic lower and upper halves connected together and lockable together by protrusions and recesses in the halves. The upper and lower halves have one or more chambers defined by chamber halves formed in the lower and upper halves that combine together to form each chamber. In the preferred embodiments of the present invention, anywhere from one to eight chambers may be provided in the packaging system. Concerning each such chamber, the lower half of the packaging system includes a recess sized and configured to receive the undersurface of a tart shell. The upper chamber half includes a generally dome-shaped portion designed to overlie a recess within the tart shell that is normally filled with an edible material and has a lower periphery spaced radially inwardly from the periphery of the lower chamber half. Radially outwardly from the lower periphery of the dome-shaped portion, a ledge is formed that overlies the outer periphery of the lower chamber half. This ledge is sized and configured to capture the periphery of a tart shell contained within the chamber and prevents movement of the tart shell out of snug engagement with the lower chamber half.

14 Claims, 6 Drawing Sheets

PACKAGING SYSTEM FOR TART SHELLS

BACKGROUND OF THE INVENTION

This invention relates to a packaging system for food. More particularly, it refers to a plastic two sided package coupled together for holding tart shells and pie crusts. It is well known that tarts are made in a process including at least two distinct steps. First, the tart shells are manufactured. Secondly, the tart shells are filled with a filler such as a jelly, a cake, or some other edible substance.

Frequently, when filled tart shells are transported the shells themselves are cracked or the filling that has been provided in an aesthetic display is defaced or deformed through engagement with the internal walls of the container in which the tart shells are transported. As such, a need has developed for a packaging system for tart shells that allows filled or unfilled tart shells to be easily and safely transported without damage even in the event they are inverted. It is with this need in mind that the present invention was developed.

Applicant is aware of the following prior art:

U.S. Pat. No. 2,793,955 to Selmer
U.S. Pat. No. 3,431,836 to Murrell
U.S. Pat. No. 3,512,458 to Ehe
U.S. Pat. No. 3,637,404 to MacManus
U.S. Pat. No. 3,692,544 to Dendrinos
U.S. Pat. No. 3,728,957 to Polus
U.S. Pat. No. 3,732,976 to Bessett et al.
U.S. Pat. No. 3,799,386 to Madalin et al.
U.S. Pat. No. 3,874,548 to Buff, Jr.
U.S. Pat. No. 4,399,157 to Caporaso
U.S. Pat. No. 4,426,002 to Rez
U.S. Pat. No. 4,874,083 to Antoni et al.
U.S. Pat. No. 4,896,774 to Hammett et al.

The present invention patentably distinguishes from the teachings of these U.S. Patents as contemplating a packaging system for tart shells having a lower half designed to receive the underside of a tart shell and an upper half including a peripheral ledge overlying the peripheral edge of the tart shell and holding it in place even if the packaging system is inverted with the upper half also including a domed structure designed to enclose the filling within the tart shell without engaging it.

SUMMARY OF THE INVENTION

The present invention relates to a packaging system for tart shells including the following interrelated objects, aspects and features:

(1) In a first aspect, the inventive packaging system includes a lower half and an upper half that may be coupled together in any suitable manner such as, for example, by respective protrusions and recesses in the halves, by a hinge or by some combination of these features.

(2) The upper and lower halves may be provided with one or more chambers defined by chamber halves formed in the lower and upper halves of the packaging system that combine together to form a chamber. In the preferred embodiments of the present invention, anywhere from one to eight chambers may be provided in the packaging system.

(3) Concerning each such chamber, the lower half of the packaging system includes a recess sized and configured to receive the undersurface of a tart shell. Many tart shells have a generally frusto-conical undersurface and, where this is the case, the chamber half in the lower half of the packaging system has a frusto-conical shape designed to snugly receive the undersurface of the tart shell. Of course, this chamber half may be made of any suitable shape and configuration designed to snugly receive the undersurface of a tart shell.

(4) The upper chamber half formed in the upper half of the packaging system includes a generally dome-shaped portion designed to overlie a recess within the tart shell that is normally filled with an edible material such as a jelly, pastry, or other edible composition. The dome-shaped portion has a lower periphery spaced radially inwardly from the periphery of the lower chamber half. Radially outwardly from the lower periphery of the dome-shaped portion, a ledge is formed that overlies the outer periphery of the lower chamber half. This ledge is sized and configured to capture the periphery of a tart shell contained within the lower chamber half. In this way, if the tart shell is inverted while contained within the packaging system, the ledge captures the periphery of the tart shell and prevents movement of the tart shell out of snug engagement with the lower chamber half.

(5) The dome-shaped portion of the upper chamber half may be of any shape or configuration including, for example, polygonal peripheral walls, curved peripheral walls or peripheral walls of any desired shape. The top wall of the dome-shaped portion may be flat or convex with any desired configuration of the peripheral walls thereof.

(6) In the preferred embodiment of the present invention, the packaging system is made of a thin, transparent, plastic material, preferably formed in a vacuum-forming process. Of course, any suitable manufacturing techniques may be employed.

As such, it is a first object of the present invention to provide a packaging system for tart shells.

It is a further object of the present invention to provide such a system including a lower half and an upper half coupled together in a suitable manner.

It is a yet further object of the present invention to provide such a packaging system wherein the upper half thereof includes a peripheral ledge designed to overlie and enclose the periphery of a tart shell.

It is a still further object of the present invention to provide such a packaging system that may be used to simultaneously enclose from one to eight or more tart shells whether filled or unfilled.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
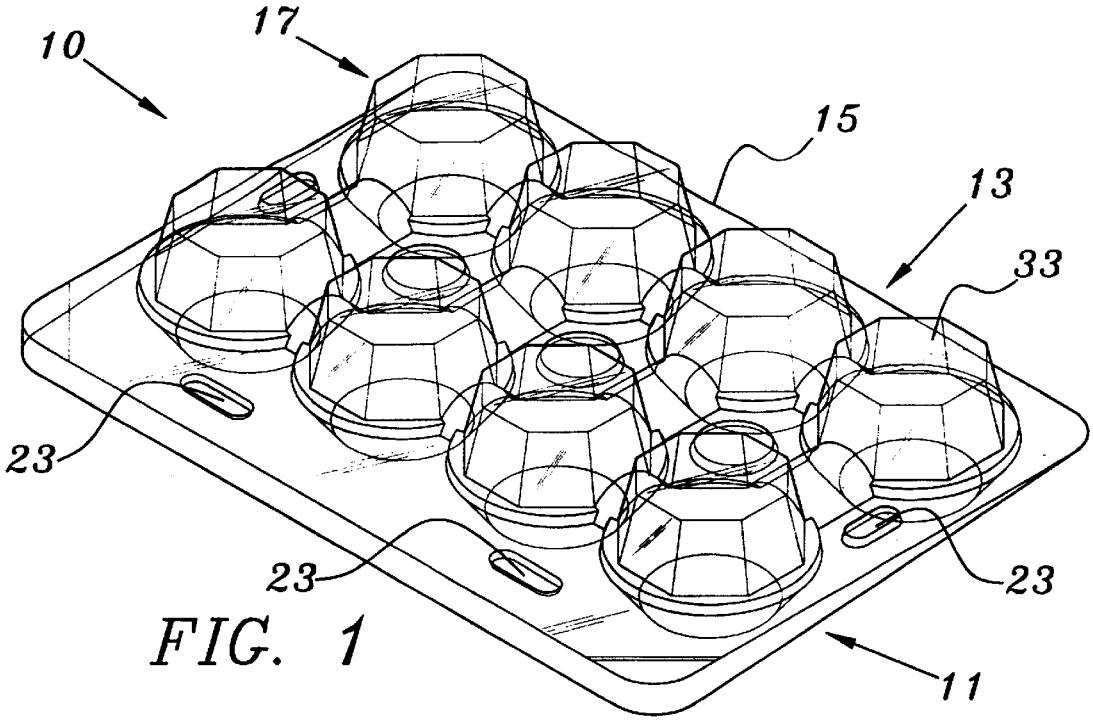
FIG. 1 shows a perspective view of a packaging system for eight tart shells.
Figure 2:
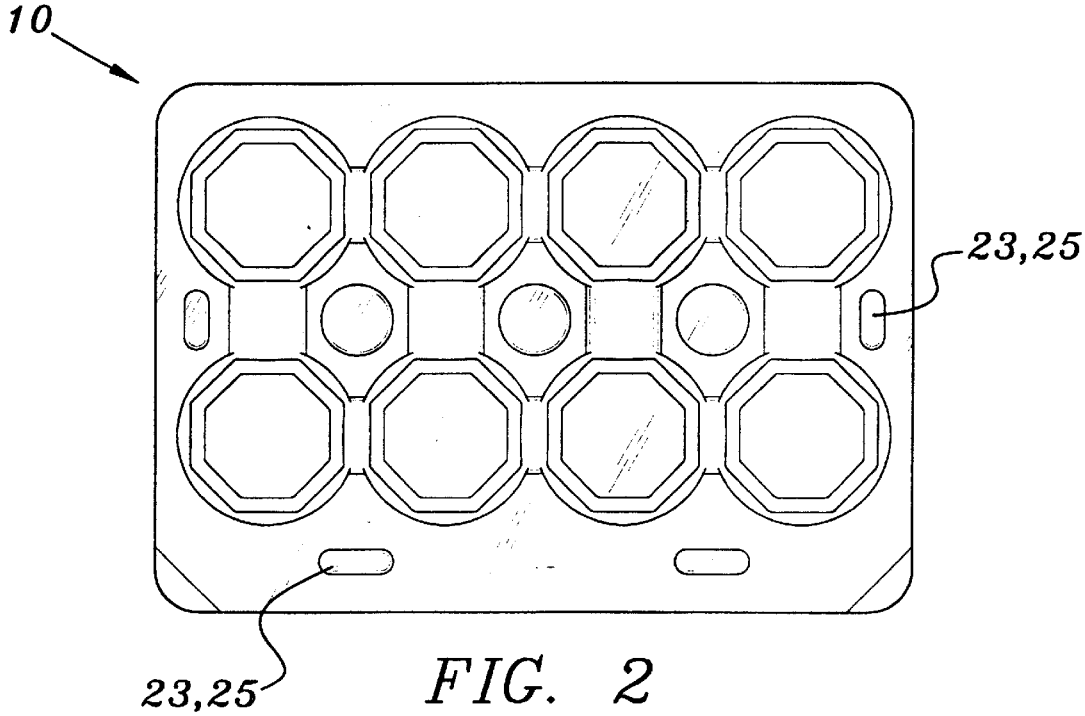
FIG. 2 shows a top view of the packaging system of FIG. 1.
Figure 3:
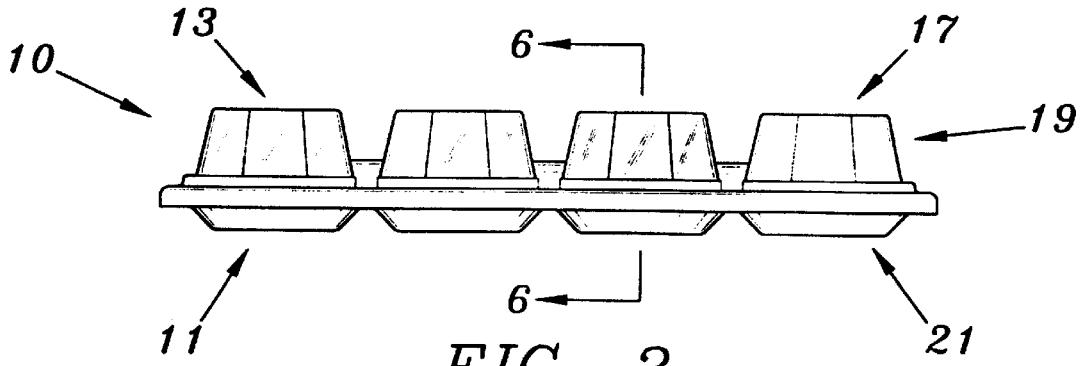
FIG. 3 shows a front view of the packaging system of FIGS. 1 and 2.
Figure 4:
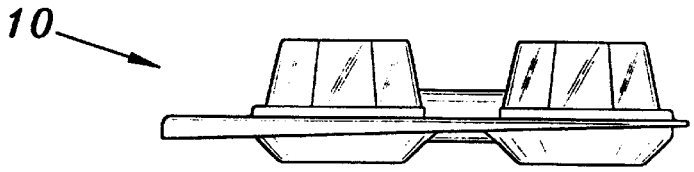
FIG. 4 shows a side view of the packaging system of FIGS. 1–3.
Figure 5:
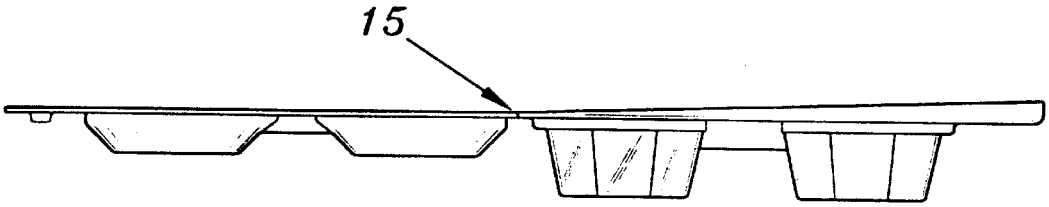
FIG. 5 shows a view of the packaging system of FIGS. 1–4 with the halves in the open position.

With reference, first, to FIGS. 1–7, a first embodiment of the present invention is generally designated by the reference numeral 10 and is seen to include a lower half 11 and an upper half 13 connected together (see FIG. 5) at a hinge 15. The packaging system 10 as depicted in FIGS. 1–7 includes eight chambers 17, each made up of an upper chamber half 19 and a lower chamber half 21. The chambers 17 are arranged in an array of chambers, two chambers wide and four chambers long, as best seen in FIGS. 1 and 2. The halves 11 and 13 are held in the closed position shown in FIGS. 1–4 and 6–7 by virtue of locking means comprising downwardly extending projections 23 formed in the upper half 13 releasably received within downwardly depending recesses 25 (FIG. 6) formed in the lower half 11.

Figure 6:
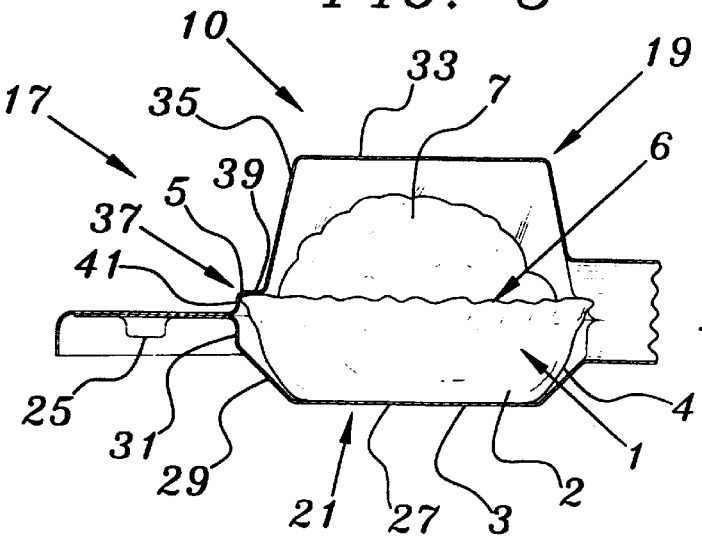
FIG. 6 shows a cross-sectional view along the line 6—6 of FIG. 3 with a tart within the chamber thereof.
Figure 7:
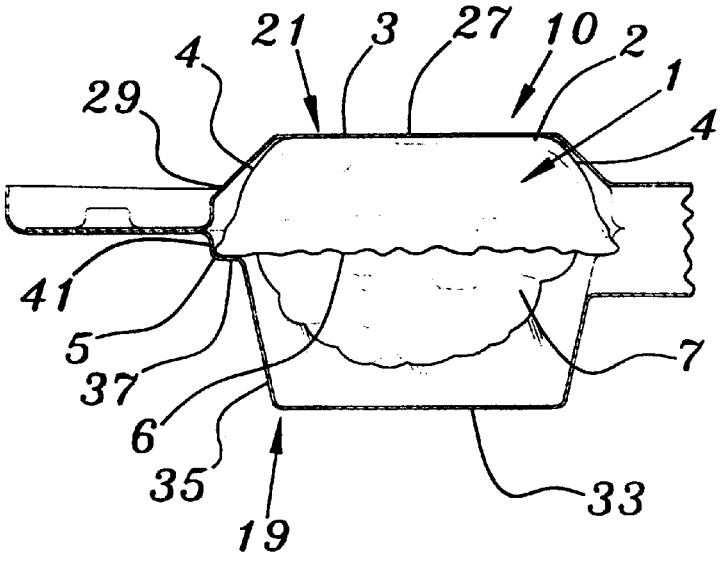
FIG. 7 shows a view similar to that of FIG. 6 but with the packaging system inverted and shown holding the tart in a secure position.

With particular reference to FIG. 6, each lower chamber half 21 includes a flat bottom 27 surrounded by frusto-conical walls 29 leading to a vertical wall 31. Each upper chamber half includes a flat top 33, angled side walls 35 and a peripheral ledge 37 formed by peripheral annular horizontal walls 39 connected to peripheral annular vertical walls 41. As particularly seen in FIG. 6, the ledge 37 overlies an upper portion of the frusto-conical walls 29 of the lower half 21.

With further reference to FIG. 6, a schematic representation of a tart is generally designated by the reference numeral 1 and is seen to include a tart shell 2 having a bottom wall 3, generally conical side walls 4, an upper outer corner 5 and an outer periphery 6. As seen in FIG. 6, the tart shell 2 is filled with a filling 7 that may be any desired edible substance such as a jelly, cheese, cake, frosting, fruit or any other desired edible material. As should be particularly understood from viewing of the left-hand side of the chamber 17 in the view of FIG. 6, the outer peripheral corner 5 of the tart shell 2 is captured by the ledge 37 of the upper chamber half 19 of the chamber 17, thereby locking the tart shell 2 in the position shown in FIG. 6. The bottom wall 3 of the tart shell 2 conforms to the bottom wall 27 of the lower chamber half 21 while the side walls 4 of the tart shell 2 generally conform to a lower portion of the frusto-conical wall 29 of the lower chamber half 21, an upper portion of tart shell side walls 4 angling away from an upper portion of the frusto-conical wall 29 and vertical wall 31 to create an empty space therebetween. In this way, even if the tart shell 2 does not have a filling 7 contained therein, the tart shell 2 is snugly retained within the chamber 17 in such a manner that even when inverted (see FIG. 7), the tart shell will not move from the position shown in FIG. 6.

As also shown in FIG. 6 (and in FIG. 7), the dome-shape of the upper chamber half 19 encloses the filling 7 in such a manner that even if the packaging system 10 is inverted (FIG. 7), the filling 7 remains securely in place and undamaged.

In comparing FIGS. 1 and 6, it is evident that the walls 35 of the upper chamber half 19 comprise a series of trapezoidal walls about the periphery of the octagonal top wall 33.

Figure 8:
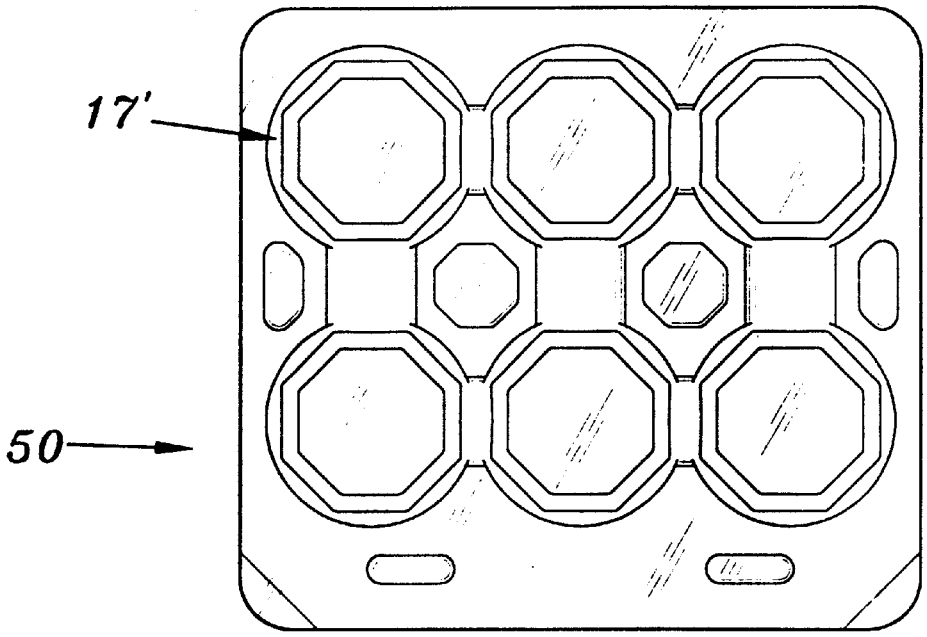
FIG. 8 shows a top view depicting a modified packaging system for six tart shells.
Figure 9:
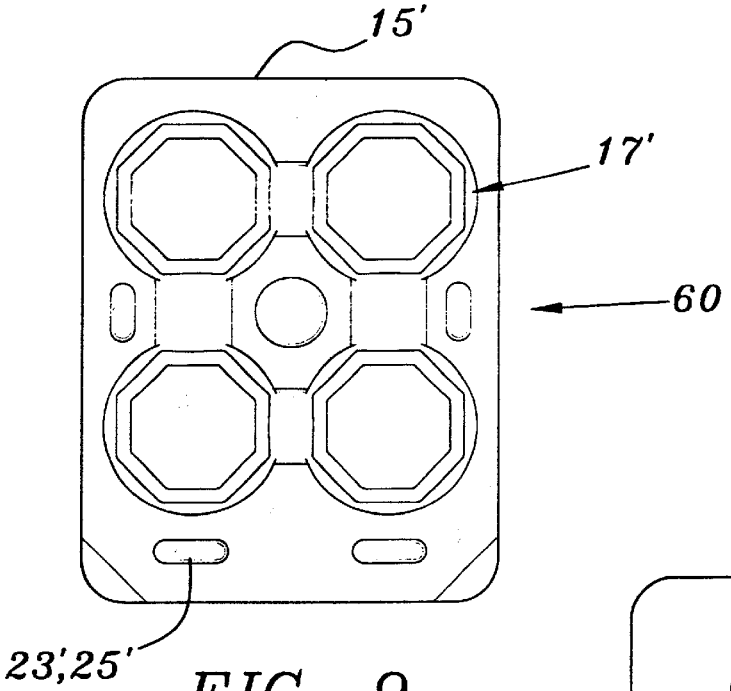
FIG. 9 shows a top view of a further modification for four tart shells.
Figure 10:
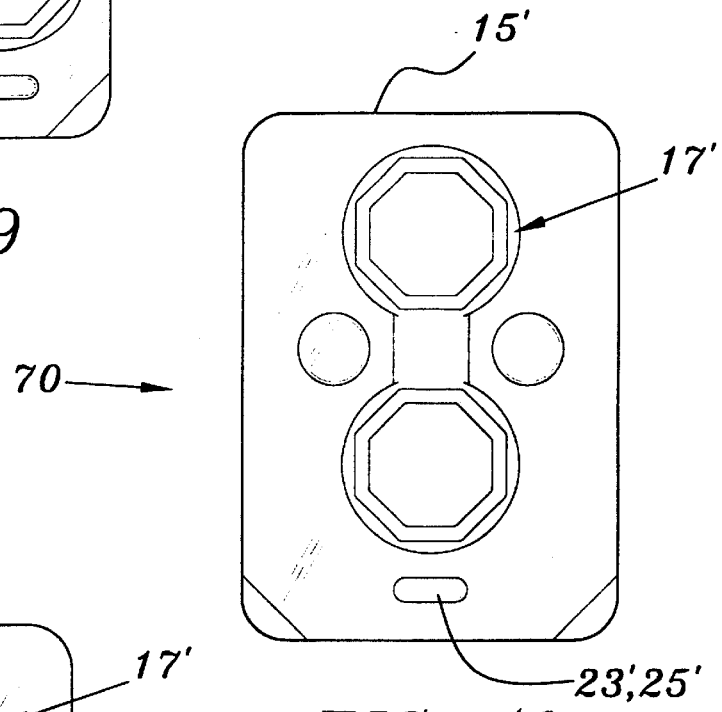
FIG. 10 shows a top view of a yet further modification for two tart shells.
Figure 11:
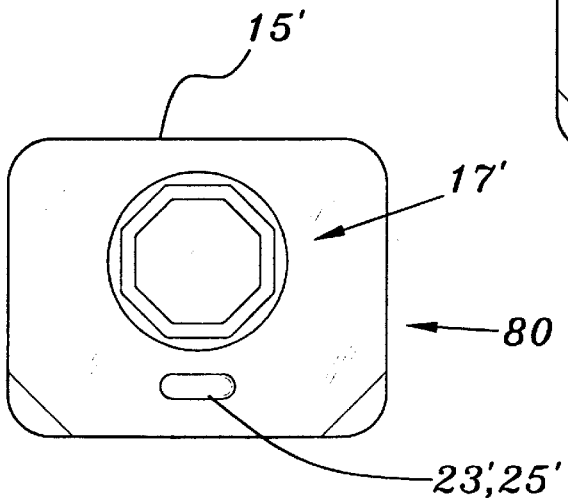
FIG. 11 shows a top view of a still further modification for one tart shell.

FIG. 8 shows a packaging system 50 similar to that of FIGS. 1–7 but including provision for six chambers 17'. FIG. 9 shows a further modification consisting of a packaging system 60 including four chambers 17'. FIG. 10 shows a still further modification referred to with the reference numeral 70 and including two chambers 17'. FIG. 11 shows a yet further modification designated by the reference numeral 80 and including a single chamber 17'.

In FIGS. 8–11, elements that correspond to like elements in FIGS. 1–7 are designated with like primed reference numerals.

Figure 12:
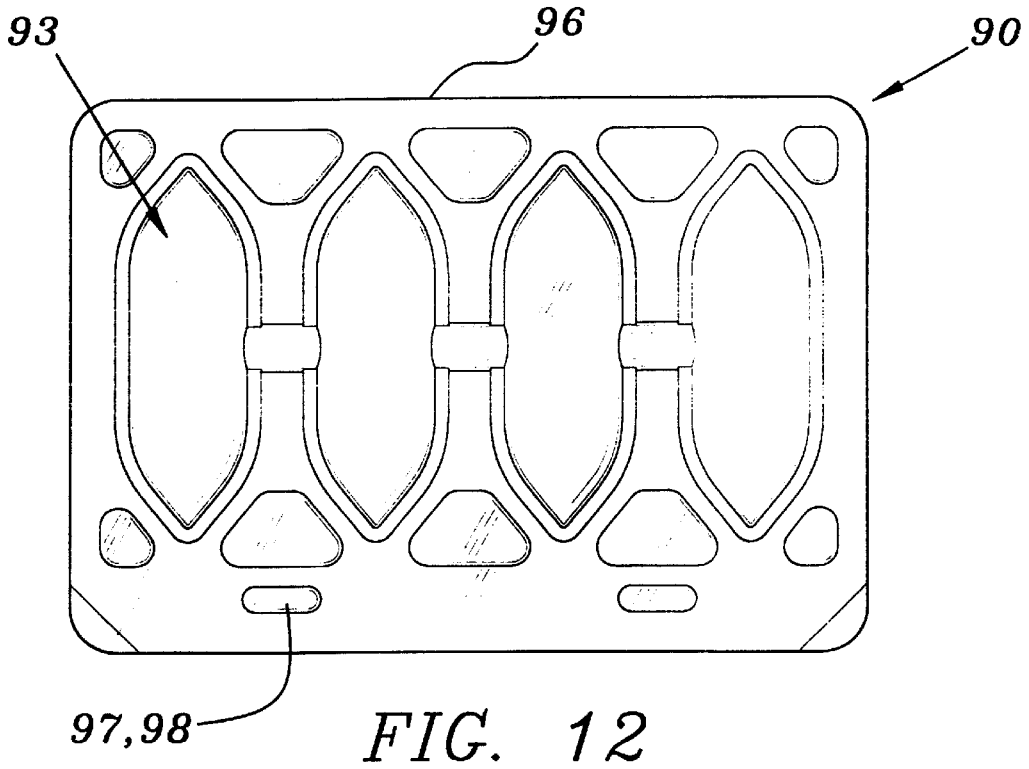
FIG. 12 shows a top view of a yet further modification having boat-shaped chambers.
Figure 13:
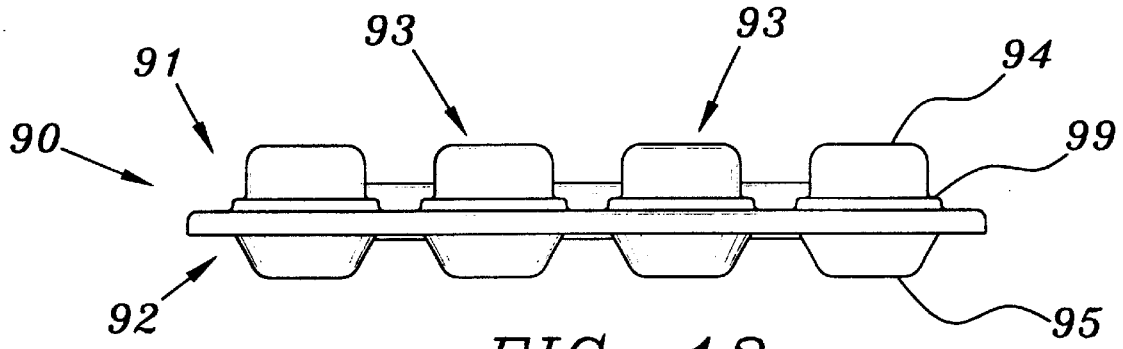
FIG. 13 shows a front view of the embodiment of FIG. 12.
Figure 14:
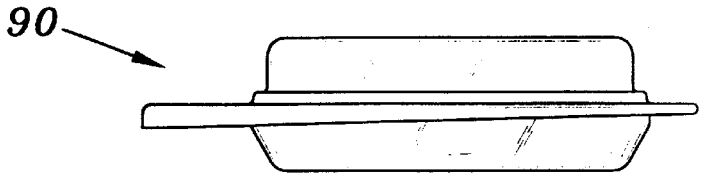
FIG. 14 shows a side view of the embodiment of FIGS. 12–13.

FIGS. 12–14 depict a further modification designated by the reference numeral 90 and including an upper half 91 and a lower half 92 defining four chambers 93, each of which includes an upper chamber half 94 and a lower chamber half 95. These halves 91 and 92 may be interconnected together at a hinge 96 and locking means 97, 98 corresponding to the locking means 23, 25 of the embodiment of FIGS. 1–7 may also be employed. The upper chamber half 94 includes a ledge 99 corresponding to the ledge 37 of the upper chamber half 19 of the chamber 17 of the packaging system 10.

As best seen with reference to FIG. 12, the chambers 93 are generally boat-shaped including tapered ends and a generally elongated widest central section. In the packaging system 90, tart shells (not shown) having an elongated shape corresponding to the shape of the chambers 93 may be enclosed therein in the same manner as is the case in the embodiments illustrated in FIGS. 1–11. As seen in FIGS. 13 and 14, the dome shape of the upper chamber halves 94 allows safe enclosure of filling (not shown) within the tart shells (not shown) in a manner corresponding to the tart shells 2 and filling 7, best illustrated in FIGS. 6 and 7. The ledge 99, corresponding to the ledge 37, are sized and configured to enclose and capture the upper outer periphery of the tart shells so that they will remain in place even if the packaging system is inverted from the orientation shown in FIGS. 13 and 14.

Figure 15:
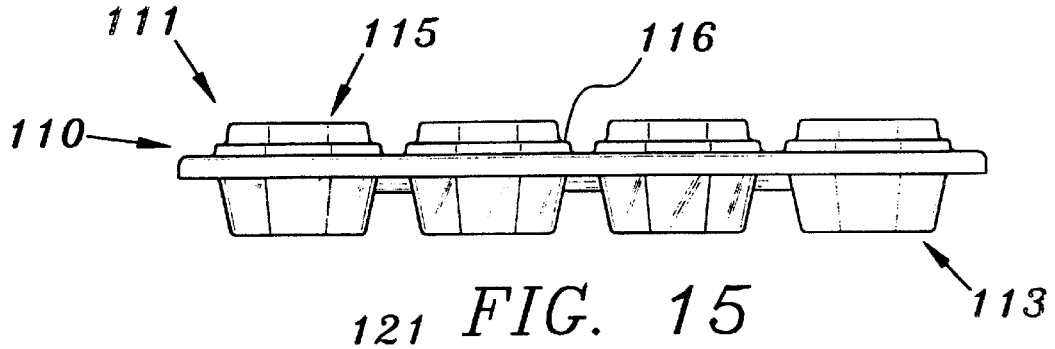
FIG. 15 shows a front view of a further modification wherein the upper chamber half is smaller than the lower chamber half.

FIGS. 15, 16, 17 and 18 depict other possible configurations for the chambers defined in the packaging systems in accordance with the teachings of the present invention. Thus, FIG. 15 depicts a packaging system 110 including chambers 111 defined by large lower chamber halves 113 and relatively small upper chamber halves 115. The upper chamber half 115 includes a ledge 116 for the same purpose as the ledge 37 best illustrated in FIG. 6.

Figure 16:
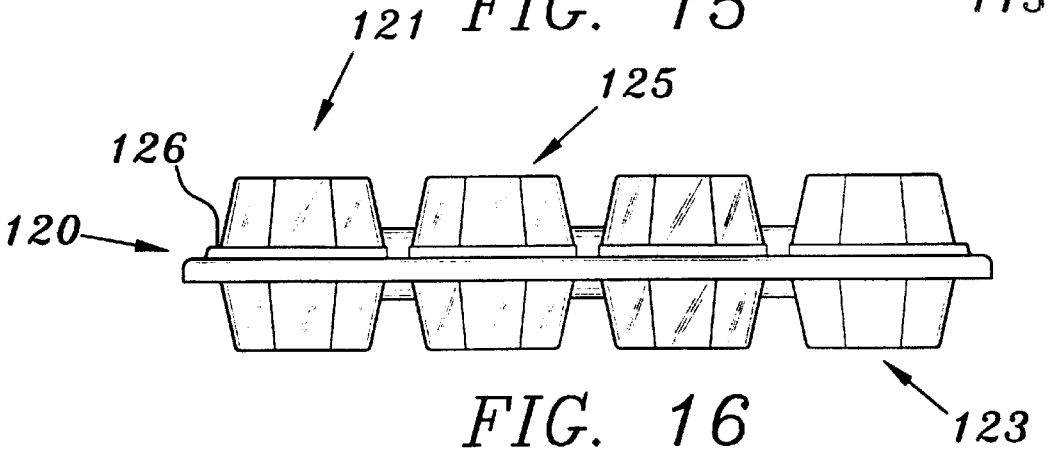
FIG. 16 shows a front view of a further modification wherein the upper and lower chamber halves are approximately the same size.

In FIG. 16, the packaging system 120 includes chambers 121 comprised of relatively equally sized large lower chamber halves 123 and upper chamber halves 125. In the embodiments illustrated in FIGS. 15 and 16, the peripheries of the upper and lower chamber halves are generally similar to those of the upper chamber halves 19, best seen in FIG. 1 to be of a generally octagonal periphery made up of a flat, octagonal top and trapezoidal sides about the periphery thereof. The upper chamber half 125 includes a ledge 126 provided for the same purpose as the ledge 37 best seen in FIG. 6.

Figure 17:
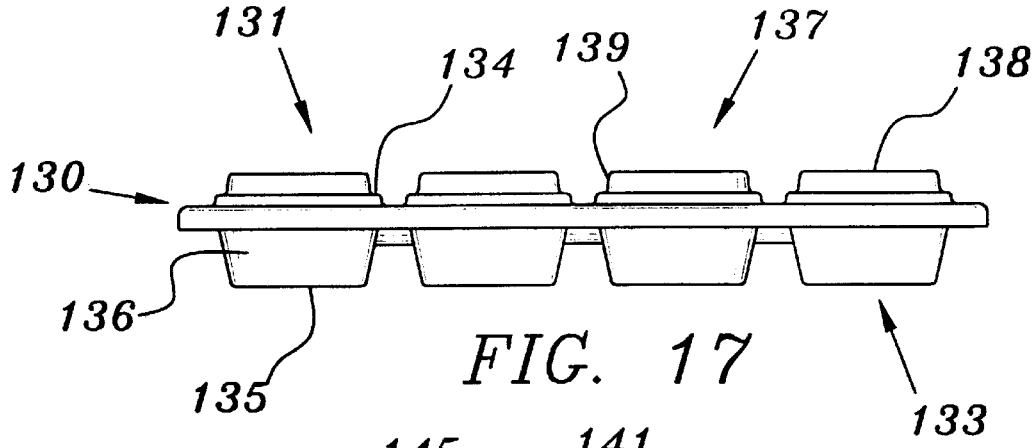
FIG. 17 shows a front view of a further modification wherein the peripheries of the upper and lower chamber halves have generally circular cross-sections.

In FIG. 17, a packaging system 130 is seen to include chambers 131 composed of lower chamber halves 133 including flat circular bottoms 135 and frusto-conical peripheries 136 and upper chamber halves 137 composed of flat circular tops 138 and frusto-conical peripheries 139. The upper chamber half 137 includes a ledge 134 provided for the same purpose as the ledge 37 best seen in FIG. 6.

Figure 18:
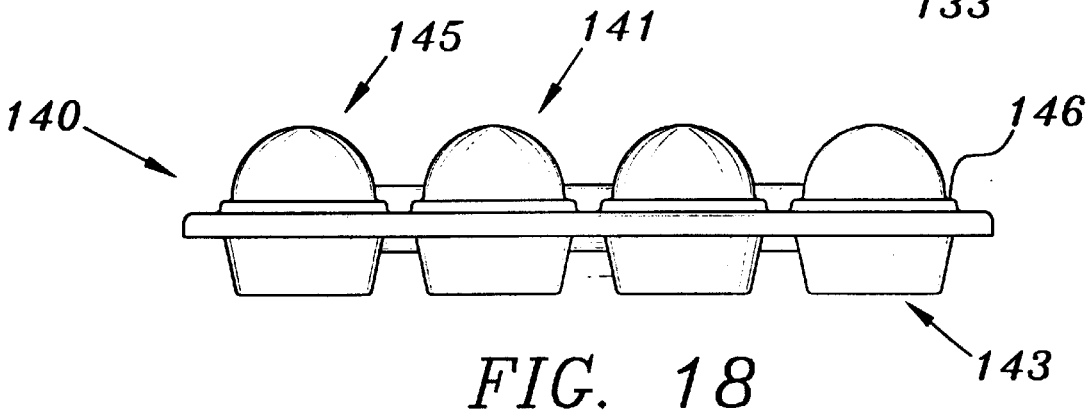
FIG. 18 shows a front view of a modification to the embodiment of FIG. 17 wherein the upper chamber halves have domed tops.

FIG. 18 depicts a packaging system 140 wherein the chambers 141 are composed of lower chamber halves 143 generally the same as the lower chamber halves 133 of the packaging system 130 and upper chamber halves 145 that are dome-shaped. The upper chamber half 145 includes a ledge 146 provided for the same purpose as the ledge 37 best seen in FIG. 6.

In all of the embodiments of the present invention as illustrated in FIGS. 1–18, the packaging systems are preferably made of a thin, transparent, plastic material such as vacuum-formed plastic. Of course, any desired plastic material may be used and the packaging systems also may be made using any suitable process such as, for example, injection molding.

As such, an invention has been disclosed in terms of preferred embodiments thereof which fulfill each and every one of the objects of the invention as set forth hereinabove and provide new and useful embodiments of a packaging system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A packaging system for tart shells comprising:

a) an upper half and a lower half releasably connectable together;

b) a chamber formed by portions of said upper and lower halves including an upper chamber half in said upper half and a lower chamber half in said lower half;

c) said lower chamber half including a flat bottom surface and frusto-conical peripheral walls extending from said bottom surface upwardly and continuously to a vertical wall of said lower chamber half, said vertical wall extending upwardly and continuously to an upper horizontal surface of said lower half;

d) said upper chamber half comprising a generally dome-like configuration having, relative to the top of the dome-like configuration, a lower periphery connected to an annular ledge, said annular ledge having an outwardly extending horizontal portion and a downwardly extending vertical portion, said annular ledge outwardly extending horizontal portion disposed above a portion of said frusto-conical peripheral walls, said annular ledge downwardly extending vertical portion in axial alignment with said lower chamber half vertical wall and extending to a lower horizontal surface of said upper half, which in turn is adjacent to said upper horizontal surface of said lower half; and e) a frusto-conical tart shell having outwardly extending walls, an upper outer edge and a bottom flat surface, said tart shell being located substantially in said lower chamber half, the upper outer edge of said shell walls, overhanging an upper portion of said frusto-conical peripheral walls of said lower chamber half and the frusto-conical peripheral walls of said lower chamber being angled away from said walls of said tart shell such that a space exists between an upper portion of said shell walls and an upper portion of said lower chamber peripheral walls, an upper surface of said outer edge of said tart shell contacting said annular ledge outwardly extending horizontal portion while simultaneously a bottom flat surface of said tart shell contacts and conforms to said flat bottom surface of said lower chamber half so that said tart shell is retained within said lower chamber half even if said packaging system is inverted.

2. The packaging system of claim 1, further including a hinge connecting said upper and lower halves.

3. The packaging system of claim 2, further including locking means for releasably locking said halves together.

4. The packaging system of claim 1, including a plurality of chambers.

5. The packaging system of claim 4, including two chambers.

6. The packaging system of claim 4, including four chambers.

7. The packaging system of claim 4, including six chambers.

8. The packaging system of claim 4, including eight chambers.

9. The packaging system of claim 1, wherein said upper chamber half has a generally octagonal top surface and eight generally trapezoidal side walls.

10. The packaging system of claim 9, including two chambers.

11. The packaging system of claim 9, including four chambers.

12. The packaging system of claim 9, including six chambers.

13. The packaging system of claim 9, including eight chambers.

14. The packaging system of claim 1, wherein said upper chamber half has a generally circular flat top surface and generally frusto-conical side walls.

* * * * *